US007191756B2

(12) United States Patent
Phlips et al.

(10) Patent No.: US 7,191,756 B2
(45) Date of Patent: Mar. 20, 2007

(54) SYSTEM AND METHOD FOR CONTROLING CRANKSHAFT POSITION DURING ENGINE SHUTDOWN USING CYLINDER PRESSURE

(75) Inventors: Patrick Phlips, Cologne (DE); Bernd Steiner, Bergish-Gladbach (DE); Klemens Greiser, Langenfeld (DE); Ulrich Kramer, Bergisch-Gladbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/164,047

(22) Filed: Nov. 8, 2005

(65) Prior Publication Data

US 2006/0102112 A1 May 18, 2006

(30) Foreign Application Priority Data

Nov. 16, 2004 (EP) ..... 04105811
Dec. 3, 2004 (EP) ..... 04106259

(51) Int. Cl.
*F02D 17/00* (2006.01)

(52) U.S. Cl. ..... 123/366

(58) Field of Classification Search ..... 123/48 R, 123/366, 48 A, 48 AA, 48 B, 48 D
See application file for complete search history.

(56) References Cited

U.S. PATENT DOCUMENTS 3,970,056 A * 7/1976 Morris ..... 123/48 D
4,406,951 A 9/1983 Inoue
5,183,013 A * 2/1993 Ito et al. ..... 123/48 R
5,193,493 A * 3/1993 Ickes ..... 123/48 R
5,456,233 A 10/1995 Felhofer
5,636,611 A 6/1997 Frankle et al.
6,199,520 B1 * 3/2001 Warren ..... 123/48 R
6,691,655 B2 * 2/2004 Aoyama et al. ..... 123/90.16
2001/0018903 A1 9/2001 Hirose et al.
2002/0078928 A1 6/2002 Onishi
2003/0204302 A1 10/2003 Naoki
2004/0123831 A1 7/2004 Grieser et al.
2004/0144342 A1 * 7/2004 Sieber et al. ..... 123/48 R (Continued)

FOREIGN PATENT DOCUMENTS

DE 4227699 A1 2/1994

(Continued)

OTHER PUBLICATIONS

EPO Search Report, App. No. 04105811.6, Apr. 27, 2005.

(Continued)

*Primary Examiner*—Stephen K. Cronin
*Assistant Examiner*—Jason Benton
(74) *Attorney, Agent, or Firm*—Donald J. Lewis; Bir Law, PLC

(57) ABSTRACT

Systems and methods for controlling stopping position of a crankshaft during shutdown of a multiple cylinder internal combustion engine influence cylinder pressure independent of associated intake/exhaust valves during shutdown of the engine so the crankshaft stops in a position favorable for restarting. Embodiments include an engine having variable compression ratio cylinders with the compression ratio of the cylinders controlled to vary cylinder pressure during shutdown to control stopping position of the crankshaft, or an auxiliary control valve disposed in a cylinder wall to control pressure within the cylinders during shutdown so the crankshaft stops in a position desirable for restarting.

13 Claims, 2 Drawing Sheets

U.S. PATENT DOCUMENTS

2004/0149245 A1 8/2004 Moriya

FOREIGN PATENT DOCUMENTS

| | | | |
|---|---|---|---|
| DE | 10151505 | A1 | 7/2002 |
| EP | 0737800 | A | 10/1996 |
| EP | 1074713 | A | 2/2001 |
| EP | 1403488 | A | 3/2004 |
| EP | 1413727 | A | 4/2004 |
| EP | 1439295 | A | 7/2004 |
| EP | 1471233 | A | 10/2004 |

OTHER PUBLICATIONS

EPO Search Report, App. No. 04106259.7, Apr. 1, 2005.
U.S. Appl. No. 11/164,017; "Engine Shutdown Using Fluid Pump to Control Crankshaft Stopping Position"; Filed Nov. 7, 2005.
U.S. Appl. No. 11/163,975; "Systems and Methods for Controlled Shutdown and Direct Start for Internal Combustion Engine"; Filed Nov. 4, 2005.

* cited by examiner 9
8
2
11
3
1
10
5
7
4
6
15
12
14
13

SYSTEM AND METHOD FOR CONTROLING CRANKSHAFT POSITION DURING ENGINE SHUTDOWN USING CYLINDER PRESSURE

CROSS REFERENCE TO RELATED APPLICATIONS

This application claims priority under 35 USC §119 to European Patent Application Nos. 04105811.6, filed Nov. 16, 2004 and 04106259.7 filed Dec. 3, 2004.

BACKGROUND OF THE INVENTION

1. Field of the Invention

The present invention relates to systems and methods for controlling the stopping position of an engine crankshaft during engine shutdown to provide a favorable position for restarting.

2. Background Art

One concept for improving fuel consumption of a vehicle is to shut down the internal combustion engine if there is no requirement for power instead of allowing it to continue to idle. One application is stop and go traffic that may occur in traffic jams on freeways as well as at traffic lights, railroad crossings, etc.

One problem with the concepts that shut down the internal combustion engine when it is not required to improve fuel consumption is the necessity to start the internal combustion engine again. When the engine is shut down in an uncontrolled way, the crankshaft and the camshaft stop in an unknown random position. Consequently, the position of the pistons in the individual cylinders of the engine is also unknown and is left to chance. Accurate crankshaft position information is, however, useful for restarting the engine in an uncomplicated manner that is as fast and efficient as possible and thus saves fuel. For example, in engines with direct injection, it is possible to start or restart the engine directly from the stationary state without a starter motor by injecting fuel directly into the combustion chambers and igniting the fuel/air mixture using a spark plug. To be carried out successfully, it is advantageous if the crankshaft is at or near a specific position at the commencement of the starting so that at least one piston is in a position where a fuel injection and subsequent ignition of the air/fuel mixture lead to movement of the piston within the cylinder. In a four-stroke internal combustion engine, the piston would have to be in the expansion or working stroke with at least one associated exhaust valve closed. As such, this method for direct starting or restarting requires an accurate indication of the crankshaft position or piston position to select appropriate cylinders for the fuel injection to start the engine.

In an internal combustion engine equipped with an electronically regulated ignition and/or an electronically regulated injection, markers arranged on the crankshaft supply signals about the crankshaft position to sensors which are connected to the engine control system to control the ignition time and the injection time. However, these sensors require rotation of the crankshaft to provide a signal and provide ambiguous information for a number of cylinder firings immediately after starting or restarting the engine so that some time is required to synchronize the crank angle position and the engine control parameters. In addition, devices have to be provided for starting or restarting the engine, such as a conventional starter motor, electric motor, or a similar device suitable for rotating the crankshaft.

Various concepts have been proposed in the prior art for controlling the stopping position of the crankshaft (or adjusting the position after the engine is stopped) and for restarting the engine. These concepts may generally be categorized as either active or passive. The active adjustment devices either require additional components, such as an additional electric motor, to apply an adjustment torque, or operate using an additional fuel injection or ignition in the same way as when selective combustion processes are initiated to set the predefined crank angle position. Concepts employing active devices that require additional fuel or electrical energy are contrary to the basic goal of shutting down the engine to save fuel or energy to improve fuel economy.

Passive adjustment devices may use the rotational movement of the crankshaft during shut down after fuel and/or ignition have ended to control the stopping position of the crankshaft in a predefined advantageous position. For example, an intake/exhaust (gas exchange) valve control system may be used as a passive adjustment device to exert a stopping or braking force on the engine or crankshaft to control the deceleration of the shaft and its stopping position. This requires a relatively complex and costly variable valve control system. Many of the disclosed concepts are not suitable for controlling the stopping position of the crankshaft with the necessary accuracy to facilitate direct restart.

SUMMARY OF THE INVENTION

Systems and methods for controlling stopping position of a crankshaft during shutdown of a multiple cylinder internal combustion engine influence cylinder pressure independent of associated intake/exhaust valves during shutdown of the engine so the crankshaft stops in a position favorable for restarting.

Embodiments of the present invention include an internal combustion engine having variable compression ratio cylinders with the compression ratio of the cylinders controlled to vary cylinder pressure during shutdown to control stopping position of the crankshaft. In another embodiment of the present invention, cylinders include an auxiliary control valve disposed in a cylinder wall and controlled independently of cylinder intake/exhaust valves to control pressure within the cylinders during shutdown so the crankshaft stops in a position desirable for restarting.

The present invention provides a number of advantages. For example, as a result of the inventive variation of the compression ratio $\epsilon$ for the purpose of controlling cylinder pressure while shutting down an internal combustion engine in a controlled fashion, it is not necessary to provide additional adjustment devices, in particular active adjustment devices such as an electric motor, to turn the crankshaft to the desired position after the internal combustion engine has been shut down Rather the present invention uses passive control of cylinder pressure by controlling compression ratio or an auxiliary valve associated with the cylinders to control torque exerted on the crankshaft during shutdown until the crankshaft comes to a standstill. In comparison to active adjustment devices, the present invention has lower energy consumption because it does not initiate a rotational movement of the crankshaft but instead decelerates existing rotational movement of the crankshaft in a suitable way.

The above advantages and other advantages and features of the present invention will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the present invention as illustrated and described with reference to any one of the Figures may be combined with features illustrated in one or more other Figures to produce embodiments of the present invention that are not explicitly illustrated or described. The combinations of features illustrated provide representative embodiments for typical applications. However, various combinations and modifications of the features consistent with the teachings of the present invention may be desired for particular applications or implementations.

Figure 1:
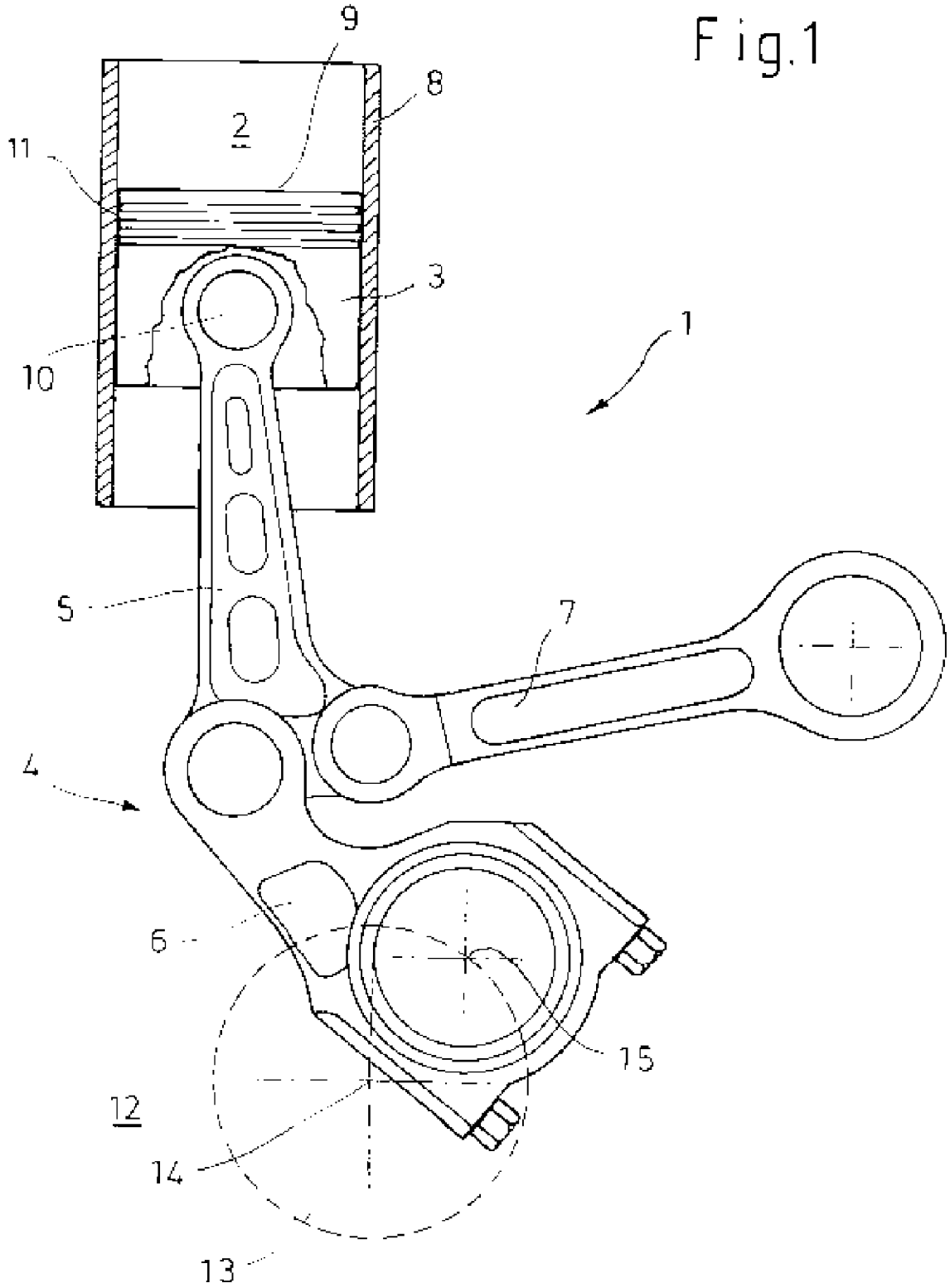
FIG. 1 illustrates a first embodiment of a system or method for controlling crankshaft stopping position during shutdown using cylinder pressure according to the present invention.

FIG. 1 illustrates a system or method for controlling crankshaft stopping position according to a first embodiment of the present invention. Crank drive 1 includes a piston 3 which forms, with piston crown 9, a part of the inner wall of the combustion chamber and is guided axially in a cylinder 8, with cylinder 8 also bounding combustion chamber 2 laterally. In addition, piston 3 together with piston rings 11 seals combustion chamber 2 against crank casing 12 so that no combustion gases pass into crank casing 12 and no oil passes into combustion chamber 2.

Piston 3 serves to transmit the gas forces generated by the combustion to crankshaft 13. For this purpose, piston 3 is connected in an articulated fashion to a connecting rod 4 by means of a piston bolt 10, with connecting rod 4 being coupled in an articulated fashion by one its ends to a crankshaft bearing pin 15 of crankshaft 13. The gas forces which are applied to piston 3 are transmitted via piston bolt 10 to connecting rod 4 and from there to crankshaft 13. The described arrangement of piston 3, piston bolt 10, and connecting rod 4 simultaneously transforms the reciprocating movement of piston 3 into a rotational movement of crankshaft 13 about crankshaft longitudinal axis 14.

According to one embodiment of the present invention, the compression ratio of at least one cylinder 8 is configured in a variable fashion to selectively influence the combustion chamber 2 pressure and thus the torque exerted on crankshaft 13. The gas forces force piston 3 downward in the direction of the longitudinal axis of cylinder 8, with an accelerated movement being imposed on piston 3 starting from the top dead center (TDC) by the gas forces. Piston 3 attempts to move away from the gas forces with its downward directed movement exerting a force on connecting rod 4 connected in an articulated fashion to crankshaft 13. Piston 3 conducts the gas forces acting on it to the connecting rod 4 via piston bolt 10 and attempts to accelerate it downward. When piston 3 approaches the bottom dead center (BDC), it is decelerated together with the components connected to it, in particular connecting rod 4, to then complete a reversal of movement at the bottom dead center (BDC). The distance the piston covers on its travel between the top dead center (TDC) and the bottom dead center (BDC) in cylinder 8 is referred to as the piston stroke s. The swept volume VH of the internal combustion engine results from the number n of cylinders and the piston area AK:

$$VH=n\cdot AK\cdot s$$

or $$VH=n\cdot Vh \text{ where } Vh=AK\cdot s,$$

Vh being the swept volume of a cylinder.

The cylinder volume VZ,TDC corresponds to what is referred to as the compression volume VC when the piston is located at the top dead center (TDC). The cylinder volume VZ,BDC at the bottom dead center of the piston (BDC) is consequently the sum of the swept volume Vh and the compression volume VC.

The geometric compression ratio $\epsilon$ of an internal combustion engine is obtained from the expression:

$$\epsilon=1+Vh/VC$$

To influence the torque transmitted to crankshaft 3, at least one cylinder 8 is provided with a variable compression ratio $\epsilon$, the pressure of the gases located in the at least one cylinder 8 being lowered by decreasing the compression ratio $\epsilon$ and the torque which is exerted on the crankshaft by the gases being reduced.

Figure 2:
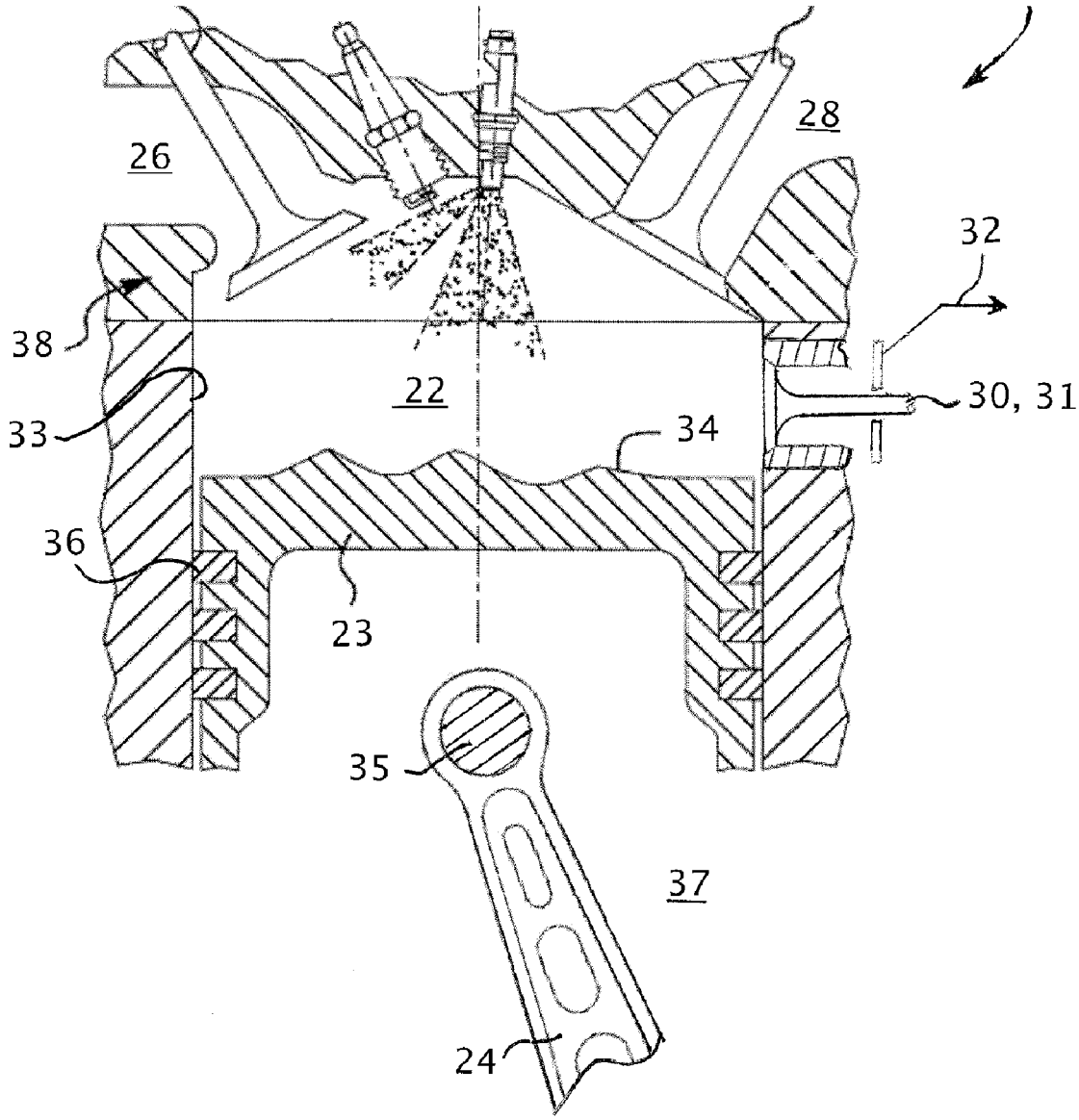
FIG. 2 illustrates a second embodiment of a system or method for controlling crankshaft stopping position during shutdown using cylinder pressure according to the present invention.

Each cylinder or combustion chamber 8 is also bounded laterally by the cylinder head and by the cylinder block in which a cylinder 8 can be formed or arranged, and in the downward direction by piston 3 guided in an axially moveable fashion in cylinder 8. Piston 3 together with piston rings 11 seals the combustion chamber against crankcase 12. In the upward direction, combustion chamber 2 is bounded by the cylinder head and the control elements which are arranged in the cylinder head and which are usually embodied as reciprocating valves as shown in FIG. 2.

In these embodiments, the present invention uses a variable compression ratio $\epsilon$, to influence the instantaneous combustion chamber volume and consequently the pressure of the gases located in the combustion chamber. A variable compression ratio $\epsilon$ may be implemented in different ways depending upon the particular application.

In one embodiment of the present invention the cylinder block is provided with a variable cylinder block height hB to implement a variable compression ratio $\epsilon$. By increasing and decreasing the cylinder block height hB the pressure of the gases located in the cylinders is influenced as a result of the change in the compression ratio $\epsilon$ so that a torque exerted on the crankshaft by the gases located in the n cylinders is influenced. This torque is controlled in such a way that the energy of the engine after the shutting off of the ignition and/or of the fuel supply until the engine comes to a standstill is consumed by torque corresponding to cylinder pressure in a controlled fashion such that the crankshaft is stopped in a known position favorable for restarting.

In another embodiment of the present invention the cylinder head is provided with a variable cylinder head height hK to implement a variable compression ratio $\epsilon$. By increasing and decreasing the cylinder head height hK, the pressure of the gases located in the cylinders is influenced as a result of the change in the compression ratio $\epsilon$ so that torque exerted on the crankshaft by the gases located in the n cylinders is influenced. As with previously describe embodiments, this torque is controlled during shut down to control the crankshaft stopping position.

Compression ratio $\epsilon$ may also be varied according to the present invention in a system having at least one piston in at least one cylinder provided with a variable piston height hP.

By increasing and decreasing the piston height hP of the at least one piston, the pressure of the gases located in the at least one cylinder is influenced so that a torque exerted on the crankshaft by the gases located in the n cylinders is influenced to control the stopping position of the crankshaft. A variable piston height changes the combustion chamber volume available to the gases.

In other embodiments of the present invention at least one crankshaft elbow of the crankshaft is of variable design in at least one clyinder, i.e. is provided with a variable distance hZ from the crankshaft longitudinal axis, to implement a variable compression ratio $\epsilon$, such as illustrated in FIG. 1, for example. A crankshaft elbow generally comprises two crank side elements which are arranged spaced apart from one another on the crankshaft, with a crankshaft bearing pin for receiving a connecting rod being arranged between the crank side elements at a distance from the crankshaft. A variable crankshaft elbow, i.e. a crankshaft elbow whose crankshaft bearing pin is provided with a variable distance hZ from the crankshaft longitudinal axis may be implemented, for example, by means of crankshaft side elements with a variable length. By increasing and decreasing the distance hZ from the at least one elbow, the pressure of the gases located in the at least one cylinder is influenced as a result of the change in the compression ratio $\epsilon$ so that a torque exerted on the crankshaft by the gases located in the n cylinders is influenced. The torque is controlled to control the stopping position of the crankshaft as previously described. Embodiments of the invention in which all n crankshaft elbows are of variable design are advantageous. As a result, all n cylinders have a variable compression ratio $\epsilon$, which increases the flexibility when setting the desired crankshaft position.

With continuing reference to FIG. 1, According to the present invention, the torque which is exerted on crankshaft 13 by the gas forces via piston 3 and connecting rod 4 is used to set a desired stopping position of crankshaft 13 after the internal combustion engine has been shut down. To influence the torque transmitted to crankshaft 13, at least one cylinder is constructed with a variable compression ratio $\epsilon$. In the embodiment illustrated in FIG. 1, connecting rod 4 is provided with a variable connecting rod length l to implement a variable compression ratio $\epsilon$. The connecting rod length l is the distance between the small and large connecting rod eyes along a virtual line which connects the two connecting rod eyes, i.e. the two ends of connecting rod 4 to one another. The small connecting rod eye serves to receive piston bolt 10, while the large connecting rod eye serves to receive crankshaft bearing pin 15.

One possible way of implementing a variable connecting rod length l is to construct connecting rod 4 as a two component connecting rod. In such a case, connecting rod 4 comprises an upper connector 5 connected to piston 3 in an articulated fashion, and a lower connector 6 connected to crankshaft 13 in an articulated fashion, with upper connector 5 and lower connector 6 also being connected to one another in an articulated fashion to be pivotable with respect to one another. The connecting rod length l is changed by pivoting upper and lower connectors 5, 6 with respect to one another, i.e. by a greater or lesser degree of bending of the two component connecting rod 4.

The compression ratio $\epsilon$ is set by a coupling rod 7 connected to upper connector 5 in a pivotable fashion and is held in a rotatable fashion on an eccentric shaft mounted in the engine casing. Increasing and decreasing the connecting rod length l of connecting rod 4 influences the pressure of the gases located in combustion chamber 2 and changes the compression ratio $\epsilon$ so that the torque exerted on crankshaft 13 by the gases located in combustion chamber 2 is influenced. According to the present invention, this torque is controlled in such a way that the kinetic energy of the internal combustion engine after the ignition and/or the fuel supply has been switched off until the crankshaft comes to a standstill is consumed by the torque associated with the cylinder pressure in a controlled fashion such that crankshaft 13 is stopped in a position favorable for restarting.

According to the present invention, the compression ratio $\epsilon$ may be increased to raise the gas pressure in at least one cylinder and increase the torque exerted on the crankshaft by the gases are advantageous. During the coasting phase, the pressure building up in the combustion chamber during the compression phase has a decelerating effect on the rotational movement of the crankshaft, i.e. acts as a braking torque. The crankshaft performs compression work of the gases located in the cylinder and uses energy in the process. The coasting movement of the crankshaft is decelerated and the coasting movement shortened if the compression ratio $\epsilon$ is increased and thus the pressure level raised.

During the expansion phase, the pressurized gas relaxes in the combustion chamber, which is becoming larger. Increasing the compression ratio $\epsilon$ counteracts the reduction in the gas pressure, as a result of which the torque exerted on the crankshaft is increased, which prolongs the coasting process of the crankshaft. During the coasting phase, the pressure that builds up in the combustion chamber during the expansion phase has a driving effect on the rotational movement of the crankshaft, i.e. acts as a drive torque. The expanding gases drive the crankshaft and in the process output energy to the crankshaft, i.e. the crankshaft absorbs energy. Similarly, the compression ratio $\epsilon$ may be decreased in the compression phase to lower the gas pressure in the at least one cylinder and decrease the torque exerted on the crankshaft by the gases. During the compression phase, a decrease in the compression ratio $\epsilon$ and the associated reduction in the pressure level lead to the coasting movement of the crankshaft being decelerated to a lesser degree and to the coasting process being shortened to a lesser degree. It is to be noted that in the compression phase the torque exerted on the crankshaft acts as a braking torque.

The present invention may also decrease the compression ratio $\epsilon$ in the expansion phase to lower the gas pressure prevailing in the cylinders. During the expansion phase, the pressurized gas relaxes in the combustion chamber, which becomes larger. A decrease in the compression ratio $\epsilon$ supports the reduction of the gas pressure, resulting in reduced drive torque exerted on the crankshaft, which shortens the coasting process of the crankshaft.

Embodiments of the present invention may increase the compression ratio $\epsilon$ during the intake phase to increase the gas pressure prevailing in the cylinders, causing the torque transmitted to the crankshaft to increase. During the intake process, a partial vacuum is generated in the combustion chamber of the cylinder by the downward moving piston. Fresh air or a fresh mixture from the intake section is inducted via the inlet valve. Consequently, the force of the gas acting on the piston resulting from the difference in pressure between the combustion chamber and crankcase, pulls the piston in the direction of the top dead center, i.e. the resulting gas force counteracts the downward movement of the piston within the intake cycle, which decelerates the downward movement and equates to reducing the torque.

Embodiments of the present invention may increase the compression ratio $\epsilon$ when the pressure of the gases located in the at least one cylinder is lower than the pressure in the crankcase during the compression phase and/or expansion phase to increase the gas pressure prevailing in the at least one cylinder and reduce the decelerating torque transmitted to the crankshaft by the gases. During the coasting movement of the internal combustion engine, the torque exerted by the gas forces acts in a decelerating fashion both in the compression phase and in the expansion phase when the cylinder pressure drops below the crankcase pressure, as previously described with respect to the description of the intake phase. The torque exerted on the crankshaft can be considered a braking torque. This braking torque is then selectively reduced both in the compression phase and in the expansion phase to extend the coasting process of the crankshaft and influence the stopping position of the crankshaft.

Embodiments of the invention which control the cylinder pressure by varying the compression ratio as illustrated and described with reference to FIG. 1, or by controlling an auxiliary valve as illustrated and described with reference to FIG. 2, generally use an engine control system (not shown) to control the shutting down process. The engine control system generally has, inter alia, knowledge about other operating parameters which are useful for controlling the at least one additional control element. To set a specific preferred stopping position of the crankshaft precisely, a large amount of information is in fact necessary or helpful. In this context it is possible to have recourse to all the data which has already been measured and/or derived for the customary engine control system, in particular engine speed, crankshaft angle, temperature of the engine and a temperature that correlates to it such as the coolant temperature and/or the intake pressure in the intake manifold. The aforesaid variables have been found empirically to have the strongest influence on the coasting movement of the internal combustion engine or of the crankshaft.

According to the present invention it is necessary and/or helpful to determine kinetic energy of the drive train and/or the crankshaft after the internal combustion engine fuel and/or ignition has been switched off. A model for the coasting movement of an internal combustion engine is described, for example, in European patent application No. 03101379.0. This model takes into account the current kinetic energy of the drive train, the friction losses and/or the compression processes and expansion processes in the cylinders of the internal combustion engine. Such a model can be acquired on the basis of theoretical considerations and implemented in the form of mathematical equations. However, the model is preferably entirely, or at least partially, acquired empirically, i.e. by observing the engine behavior and conditioning the measurement data acquired in the process, and implemented as a lookup table in the engine control system.

Thus, a method according to the present invention includes the controlled shutting down of an internal combustion engine having n cylinders and having n connecting rods connected in an articulated fashion by one of their ends to a piston and connected in an articulated fashion by their other end to the crankshaft at a crankshaft elbow to couple the piston and crankshaft. The n cylinders are bounded by a cylinder block and a cylinder head and at least one cylinder has a variable compression ratio $\epsilon$, such that increasing and/or decreasing the compression ratio $\epsilon$ in at least one cylinder the pressure of the gases located in the at least one cylinder is influenced so that a torque exerted on the crankshaft by the gases located in the n cylinders is influenced. This torque is controlled so that the energy of the internal combustion engine after the switching off of the ignition and/or fuel supply until the internal combustion engine comes to a standstill is consumed by the controllable torque in a controlled fashion so the crankshaft is stopped in a predetermined position.

FIG. 2 illustrates embodiments according to the present invention that vary cylinder pressure using an auxiliary valve to control stopping position of the crankshaft during shutdown of an internal combustion engine. Cylinder 21 includes a piston 23 that forms a combustion chamber 22 with piston bowl 34. Piston 23 is guided axially in a cylindrical bore 33, which bounds combustion chamber 22 of cylinder 21 laterally. Piston 23, together with piston rings 36, seals combustion chamber 22 with respect to the crankcase 37 so that combustion gases cannot enter crankcase 37 and oil cannot enter combustion chamber 22.

Combustion chamber 22 is bounded at the top by cylinder head 38 and control elements 25, which are arranged in cylinder head 38 and which are usually embodied as exhaust/intake globe valves 27, 29. Piston 23 serves to transmit gas forces generated by combustion during the expansion phase to the crankshaft (not shown). For this purpose, piston 23 is connected in an articulated fashion to a connecting rod 24 by piston bolt 35. The gas forces applied to piston 23 are transmitted via piston bolt 35 to connecting rod 24 and from there to the crankshaft. As a result of the arrangement of piston 23, piston bolt 35, and connecting rod 24, the exclusively reciprocating movement of piston 23 is transformed into a rotational movement of the crankshaft.

The piston 23 travels from top dead center (TDC) through bottom dead center (BDC) and during its upward movement pushes the combustion gases into exhaust 26 when exhaust valve 27 is opened. The following downward movement serves to induct fresh air or a fresh air/fuel mixture via intake 28 when intake valve 29 is opened. The gases located in combustion chamber 22 are then compressed and combusted.

The torque exerted on the crankshaft by the gas forces via piston 23 and connecting rod 24 is utilized, according to the invention, to set a predetermined position of the crankshaft after the internal combustion engine has been switched off. To influence the torque which is transmitted to the crankshaft, an additional control element 30 is provided. In the embodiment illustrated in FIG. 2, an electronically controllable valve 31 is used as an additional control element 30, said valve 31 being connected to an engine control system (not illustrated) by means of a connecting line 32 for the purpose of activation. Valve 31 is arranged in the vicinity of the top dead center (TDC) to remove gas from combustion chamber 22, or allow gas to flow into combustion chamber 22, even when piston 23 is located close to the top dead center (TDC) position.

The opening of additional control element 30 leads to an exchange of gas in such a way that, depending on the pressure gradient present at that particular time, gas can escape from cylinder 21 or flow into cylinder 21. As a result the pressure within cylinder 21 and/or in the combustion chamber 22 is influenced. Consequently, torque exerted on the crankshaft by the gas forces is influenced in such a way that the kinetic energy of the internal combustion engine after the ignition and/or the fuel supply has been switched off until it comes to a standstill is consumed by the exerted torque in a controlled fashion such that the crankshaft is stopped in a known predetermined position favorable for restarting.

Within the scope of the present invention, the surroundings of the cylinder are considered to be all the systems which are adjacent to the cylinder. The gas which is removed by means of the additional control element 30 can be fed, for example, to the crankcase or else removed from the cylinder via the cylinder head. To carry out an exchange of gas, additional control element 30 must penetrate the boundaries of the cylinder 33 so that as a result of the additional control element being opened gas can flow out of the cylinder or flow into the cylinder. As a result of the use of an additional control element 30, it is not necessary to provide additional adjustment devices, in particular active adjustment devices such as an electric motor, to rotate the crankshaft into the desired position after the internal combustion engine has been switched off. Additional control element 30 can be seen as a passive adjustment device with which the torque exerted on the crankshaft is influenced selectively until the crankshaft comes to a standstill. In comparison with an active adjustment device, a passive adjustment device provides the advantage that its consumption of energy is lower since it does not initiate a rotational movement of the crankshaft but rather merely decelerates an existing rotational movement of the crankshaft in a suitable way.

Embodiments of the internal combustion engine in which at least one additional control element is provided in each of the n cylinders and with which an exchange of gas can be carried out between the respective cylinder and the surroundings are advantageous. If an additional control element 30 is provided in each of the n cylinders, this increases the flexibility and the possibilities of influencing the torque exerted on the crankshaft by the gas forces, within the scope of a process of shutting down the internal combustion engine in a controlled fashion because each cylinder is proportionally involved in the torque which is transmitted to the crankshaft. The instantaneous gas forces of the n cylinders exerted on the pistons may be different since the individual cylinders generally function, or are operated, with an offset of a specific crank angle value.

Embodiments of the internal combustion engine in which the at least one additional control element 30 is a valve, preferably an electrically controlled valve, are advantageous. The quantity of gas exchanged and/or the pressure in the cylinder can be increased or decreased by the opening time and/or the setting of the flow cross section of the additional control element. Very short opening times can be implemented by means of an electrically controllable valve, and the actuation in such a case can be carried out in a basically completely flexible fashion.

According to the invention, at least one additionally provided control element is utilized for the controlled shutting down of the internal combustion engine, and not the intake/exhaust valves present in a conventional engine for the normal combustion cycle. The present invention can therefore be applied in internal combustion engines which do not have an at least partially variable valve control systems but rather have a conventional, mechanical valve control system with fixed control times. As a result of the arrangement of an additional control element, a significantly higher degree of flexibility is achieved when the internal combustion engine is shut down than is possible with a partially variable valve control system, in which case it would be possible to implement a similarly high degree of flexibility when shutting down the internal combustion engine only with a completely variable valve control system. In addition, the control of the additional control element is less complex and therefore less costly.

The rotational movement of the crankshaft after the internal combustion engine fuel and/or ignition has been switched off continues to compress and expand the gas located in the n cylinders of the engine as the pistons continue to reciprocate in the cylinders. The intake/exhaust control elements or valves provided for the combustion cycle may either be deactivated for applications having electromagnetically activated globe valves or valve deactivation mechanisms, or they can function as they do during normal operation, i.e. open and close in an unchanged way driven by the coasting crankshaft so that air continues to be inducted and expelled. Under certain circumstances, a throttle valve provided in the induction system has been closed after the ignition and/or fuel has been switched off, which also has an effect on the gas pressure present in the combustion chambers.

To influence the combustion chamber pressure in the cylinders and thus the torque exerted on the crankshaft, according to embodiments of the present invention, an additional control element 30 is provided as previously described. Opening additional control element 30 leads to a pressure drop in the cylinder, provided that an excess pressure with respect to the surroundings of the cylinder prevails in the combustion chamber. As a result, the torque exerted on the crankshaft is reduced. Conversely, opening additional control element 30 during the induction phase, i.e. when there is a partial vacuum in the combustion chamber, causes gases to flow into the cylinder so that the torque increases.

Embodiments of the invention are advantageous in which the at least one additional control element is opened in the compression phase to lower the gas pressure prevailing in the cylinder. As a result, the torque transmitted to the crankshaft by the gases is decreased. During the coasting phase, the pressure that builds up in the combustion chamber during the compression phase has a decelerating effect on the rotational movement of the crankshaft, i.e. acts as a braking torque. The crankshaft performs compression work for the gases located in the cylinder and in the process the crankshaft energy is consumed. Opening the at least one additional control element during the compression phase leads to a drop in pressure in the corresponding cylinder if an excess pressure prevails in the combustion chamber. As a result, the torque exerted on the crankshaft is reduced and the coasting process of the crankshaft is prolonged.

Embodiments of the invention are also advantageous in which the at least one additional control element is opened in the expansion phase to lower the gas pressure prevailing in the cylinders. As a result, the torque transmitted to the crankshaft by the gases is decreased. During the expansion phase, the pressurized gas relaxes in the combustion chamber which becomes larger. Opening the at least one additional control element supports the reduction in the gas pressure resulting in the torque exerted on the crankshaft being reduced, which shortens the coasting process of the crankshaft. During the coasting phase, the pressure which builds up in the combustion chamber during the expansion phase has a driving effect on the rotational movement of the crankshaft, i.e. acts as a driving torque. The expanding gases drive the crankshaft and in the process output energy to the crankshaft, i.e. the crankshaft absorbs energy.

Embodiments of the invention are also advantageous in which the at least one additional control element is opened in the induction phase to increase the gas pressure prevailing in the cylinders. As a result, the torque transmitted to the crankshaft by the gases is increased. During the induction, a partial vacuum is generated in the combustion chamber of the cylinder by the downward moving piston, as a result of which fresh air or fresh mixture is inducted from the intake system via the inlet valves. Consequently, the gas force acting on the piston resulting from the difference in pressure between the combustion chamber and the crankcase pulls the piston in the direction of the top dead center, i.e. the resulting gas force counteracts the downward movement of the piston within the scope of the induction cycle, which brings about a deceleration of the downward movement and thus of the rotation of the crankshaft. Opening the at least one additional control element during the induction phase leads to a pressure compensation and therefore to an increased pressure in the combustion chamber as a result of additional gases flowing into the cylinder so that the decelerating torque is reduced.

Embodiments of the invention are also advantageous in which the at least one additional control element is opened in the compression phase and/or expansion phase when the pressure of the gases located in the at least one cylinder is lower than the pressure in the crankcase to increase the gas pressure prevailing in the at least one cylinder. As a result, the decelerating torque transmitted to the crankshaft by the gases is reduced. During the coasting movement of the internal combustion engine, the torque exerted by the gas forces has a decelerating effect both in the compression phase and in the expansion phase when the cylinder pressure drops below the pressure of the crankcase as previously described. The torque exerted on the crankshaft can be considered to be a braking torque. This braking torque is then selectively reduced both in the compression phase and in the expansion phase to prolong the coasting process of the crankshaft and influence the stopping position of the crankshaft.

While the best mode for carrying out the invention has been described in detail, those familiar with the art to which this invention relates will recognize various alternative designs and embodiments for practicing the invention as defined by the following claims.

What is claimed is:

1. A method for controlling stopping position of a crankshaft during shutdown of an internal combustion engine having a plurality of cylinders each with at least one associated intake and exhaust valve and an additional control element for exchanging gas between the cylinder and surroundings, the method comprising:

controlling pressure within at least one cylinder independently of operation of the at least one intake and exhaust valve by controlling the at least one additional control element to stop the crankshaft in a position favorable for restarting.

2. The method of claim 1 wherein the additional control element comprises a valve controlling an opening in a cylinder wall in a combustion chamber above top dead center of a corresponding piston.

3. The method of claim 1 wherein the control element is opened in a compression phase to reduce gas pressure in a respective cylinder and decrease torque transmitted to the crankshaft.

4. The method of claim 1 wherein the control element is opened when pressure of gases in the cylinder is lower than pressure in a crankcase to increase pressure in the cylinder.

5. The method of claim 1 further comprising:

determining energy of the engine when fuel and/or ignition is switched off, wherein the step of controlling pressure includes controlling pressure based on the energy of the engine.

6. A system for controlling stopping position of a crankshaft during shutdown of an internal combustion engine having a plurality of cylinders with each cylinder having at least one intake valve and at least one exhaust valve, the system comprising:

a device for selectively exchanging gas between a selected cylinder and associated surroundings to influence pressure within the selected cylinder during shutdown so that the crankshaft stops in a desired position favorable for restarting the engine, wherein the device operates without altering opening and closing times of the intake and exhaust valves.

7. The system of claim 6 wherein the control element comprises a valve.

8. The system of claim 6 wherein the valve controls gas exchange through an opening in a cylinder wall.

9. The system of claim 6 wherein the device is controlled based on energy of the engine when fuel and/or ignition is switched off.

10. The system of claim 6 wherein the device comprises a valve disposed in a cylinder wall above top dead center of an associated piston.

11. A system for controlling stopping position of a crankshaft during shutdown of an internal combustion engine having a plurality of cylinders with each cylinder having at least one intake valve and at least one exhaust valve, the system comprising:

a valve associated with each cylinder and selectively controllable for exchanging gas between the cylinder and associated surroundings to control pressure within at least one cylinder independently of operation of the at least one intake and exhaust valve to stop the crankshaft in a position favorable for restarting.

12. The system of claim 11 wherein the valve is disposed in a cylinder wall.

13. The system of claim 11 wherein the valve is disposed in a cylinder wall above a piston position associated with top dead center of the piston stroke.

* * * * *